US005808220A

United States Patent [19]

Yang

[11] Patent Number: 5,808,220

[45] Date of Patent: Sep. 15, 1998

[54] METHOD FOR ESTABLISHING A STRUCTURED TIMBRE DATA BASE WITH A SOUND WAVE TABLE

[75] Inventor: Ming-jer Yang, Hsinchu, Taiwan

[73] Assignee: Winbond Electronics Corp., Hsinchu, Taiwan

[21] Appl. No.: 784,930

[22] Filed: Jan. 16, 1997

[51] Int. Cl.[6] ..... G10H 7/00

[52] U.S. Cl. ..... 84/601; 84/602; 84/603; 84/604; 84/622; 84/627

[58] Field of Search ..... 84/601–606, 622–624, 84/615, 616, 627

[56] References Cited

U.S. PATENT DOCUMENTS

| | | | |
|---|---|---|---|
| 5,288,940 | 2/1994 | Izumisawa | 84/603 |
| 5,347,087 | 9/1994 | Kozuki | 84/605 |
| 5,666,432 | 9/1997 | Izumisawa | 381/118 |

*Primary Examiner*—William M. Shoop, Jr.
*Assistant Examiner*—Marlon T. Fletcher
*Attorney, Agent, or Firm*—Bacon & Thomas, PLLC

[57] ABSTRACT

The present invention relates to a method for establishing a structured timbre base with a sound wave table and, more particularly, to a method for establishing a structured timbre data file provided for data of sound waves of every kind of instrument stored in a musical synthesizer with a sound wave table to achieve an effect of reducing memory allocation and simplifying hardware complexity, having the steps of: determining a fixed total length; specifying a keynote and obtaining a plurality of sound waves according to the characteristics of different instruments to proceed recording; setting a fixed loop length; searching for a complete sampling loop wave; deleting the end portion of every timbre data file; repeating the complete sampling loop wave several times and adding to the above deleted end portion; adding a mute signal in front of every timbre data file. Therefore, a structured timbre data base is established and every timbre data file with different pitches has an identical total length and loop length.

8 Claims, 4 Drawing Sheets

METHOD FOR ESTABLISHING A STRUCTURED TIMBRE DATA BASE WITH A SOUND WAVE TABLE

BACKGROUND OF THE INVENTION

1. Field of the Invention

The present invention is generally directed to a method for establishing a structured timbre data base provided for data of primitive sound waves of every kind of instrument stored in a musical synthesizer with a sound wave table to reduce the complexity of the synthesizer hardware.

2. Description of the Prior Art

An operative principle of a musical synthesizer with a sound wave table is to record a small section of a sound wave of a certain instrument, 0.1 second for example, and store data of this small section of the sound wave into a memory after they are quantized. When synthesizing a specific sound wave of the instrument, a stored data file of the sound wave of the corresponding instrument is read out for broadcasting and the last period of the sound wave is continuously repeated, as shown in FIG. 1, to achieve an expected effect. Thus, it is necessary to store many kinds of sound waves of different instruments into the wave table of the musical synthesizer to provide timbre exchange.

The first step for establishing the sound wave table is to record the sound waves of real instruments. Therefore, it is necessary to convert the sound waves of natural instruments to digital wave data. Since the pitch of every timbre recorded is changed as the characteristic of every corresponding instrument varies, the pitch of every timbre recorded will be different and the period of a timbre wave data will be changed thereof. Because the length of every timbre data file is different, a complete sampling periodic wave, as defined in FIG. 2, has to be taken in the event that a section of the timbre data file is formed by repeatedly connecting the last period of a periodic wave. Otherwise, a noise signal will be introduced. However, the position where a complete sampling periodic wave occurs can not be humanly controlled and the complete sampling periodic wave is the end portion of the entire timbre data file, and thus the length of the entire timbre data file is changed randomly.

As described above, the length and the period of timbre data file stored in the timbre data base are not equal, as shown in FIG. 3. Thus, the musical synthesizer has to store the length and the period of every timbre data file into a read only memory (ROM) and store the length and the period of a specified timbre data into a register.

SUMMARY OF THE INVENTION

Accordingly, an objective of the present invention is to provide a method for establishing a timbre data base with a structured sound wave table.

According to an aspect of the present invention, sound waves with different timbres and different pitches are made to have an identical "loop length" by carrying out the steps of: determining a fixed total length; specifying a keynote and obtaining a plurality of sound waves with a pitch of 8 scales higher, 16 scales higher, etc., or 8 scales lower, 16 scales lower, etc., than the specified keynote according to the characteristics of different instruments being recorded; setting a period of a sound wave with the lowest scale recorded to be a fixed loop length in every timbre data file; searching backwards for a complete sampling loop wave with the fixed loop length from the end of every timbre data file; deleting the end portion of every timbre data file starting from a position where the complete sampling loop wave is found; repeating the complete sampling loop wave several times and adding them to the above position until the difference between the length here and the fixed total length previously described is less than the length of the complete sampling loop wave; adding a mute signal with a length which is the same as the above difference in front of every timbre data file. Thus, a structured timbre data base is established and every one of the timbre data files has a fixed total length and a fixed loop length.

BRIEF DESCRIPTION OF THE DRAWINGS

The above objective, other features and advantages of the present invention will become more apparent by describing in detail a preferred embodiment thereof with reference to the attached drawings, in which.

DETAILED DESCRIPTION OF THE PREFERRED EMBODIMENT

Under the condition of an identical sampling frequency, to make sound waves with different timbres and different pitches have an identical period is not possible, but to make sound waves with different timbres and different pitches have an identical "loop length" can certainly be achieved and comprises the steps of:

1. Firstly, determining a fixed total length of a timbre data file and specifying a keynote, a G note for example, with every timbre being recorded based on the G note while recording. Thus, a G1 note, G2 note, or G3 note, . . . etc. can be recorded according to the characteristics of different instruments and finally a plurality of sound waves with a G note having 8 scales of difference are obtained.
2. Since the period ratios of the sound waves with a G1 note, a G2 note and a G3 note, . . . , etc. are 1:½: ¼:⅛: . . . , the period of the sound wave with a G note having the lowest scale, (which is not necessarily a sound wave with a G1 note), is the least common multiple of the period of every timbre data file in the timbre data base. If the period of the sound wave with the lowest note is set to be the loop length L of the entire timbre data base, then the period of every timbre data file is covered therein. Therefore, one loop wave may contain a plurality of sound waves with a single period, and every kind of timbre applies to the loop waves with the same loop length to permit an operation of repeated connection.

Figure 4A:
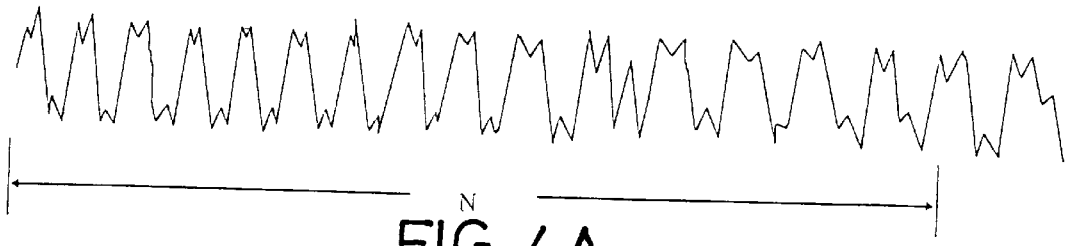
FIGS. 4A, 4B, 4C and 4D are schematic illustration showing the steps of a method for establishing a structured timbre data base in the present invention.
Figure 4B:
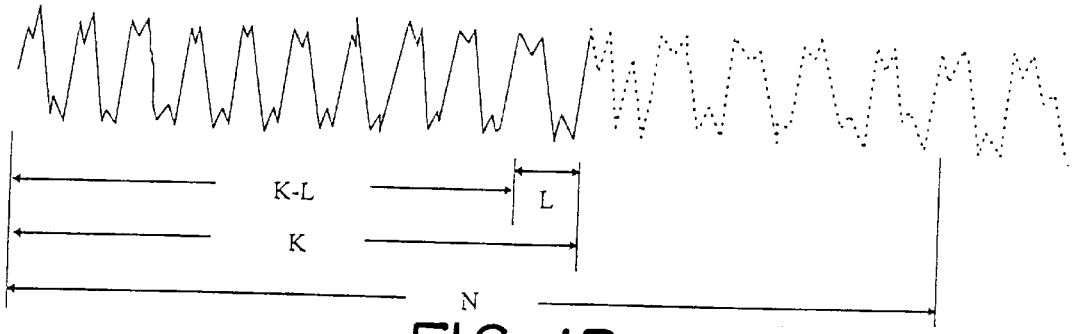

Subsequently, more than one of the complete sampling loop waves whose definitions are similar to complete sampling periodic waves can be found in every timbre data file. The length of every timbre data file will be different since the position where the complete loop wave occurs can not be predicted or controlled. Such a problem can be solved through the following steps with reference to FIGS. 4A, 4B, 4C and 4D:

(1) Referring to FIG. 4A, in the event that the length of every timbre data file is fixed to N sampling points, the complete sampling loop wave with a length L will be searched backwards starting from the final N point, that is, the end point of every timbre data file, as shown in FIG. 4B.

(2) Referring to FIG. 4B, in the event that after a complete sampling loop wave with N sampling points is obtained by searching between a K point and a K−l+1 point of every timbre data file, the sampling points after the K point of every timbre data file are all deleted such that the length of every timbre data file is K points.

Figure 4C:
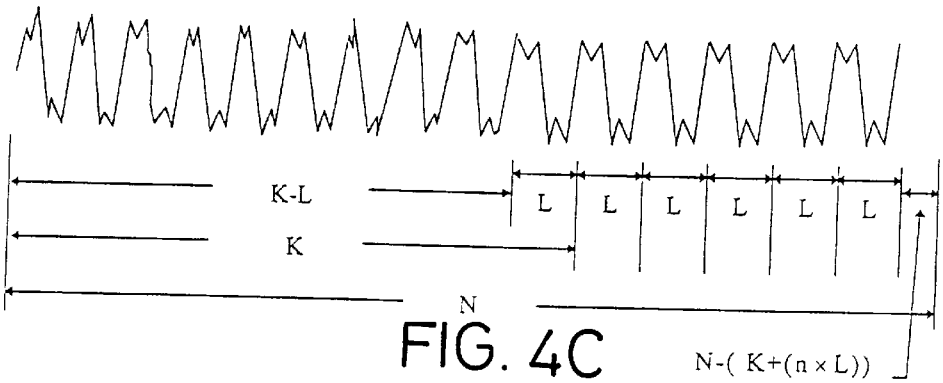

(3) Referring to FIG. 4C, the complete sampling loop wave with L sampling points is repeated itself n times and then is connected to the end of the K points to form a timbre data file with K+(n×L) points, in which the value of n is restricted to the condition of $0 \leqq N-(K+(n \times L))<L$.

Figure 4D:
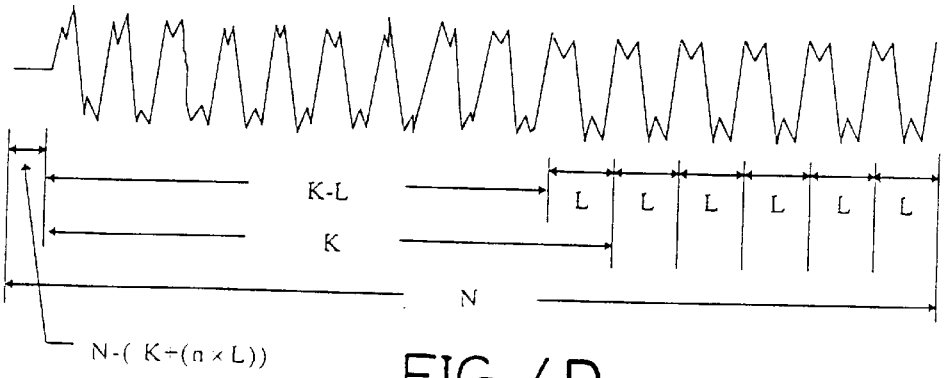

(4) Referring to FIG. 4D, to make the length of the entire timbre data file to be N points, a mute signal with N−(K+(n×L)) points is added in front of the first point of the timbre data file with K+(n×L) points. As to the added mute signal, the hearing effect of the synthesized sound will not be affected since there are only a few points added.

The method of the present invention will be described now by a preferred embodiment with reference to FIG. 5.

There are three kinds of instruments, A, B and C, and the length of every timbre data file is fixed to 4096 sampling points. Instruments A, B and C are recorded to form a timbre data file with a G2 note, a G3 note and a G4 note respectively according to the characteristics of these three instruments. Under the condition that the sampling frequency is 44100 Hz, the periods of these three timbre data files with the G2 note, the G3 note and the G4 note are 900 points, 450 points and 225 points respectively and thus the loop length of the complete sampling loop wave is set to be 900 points. These three kinds of timbre data files of A, B and C are processed through the steps described above.

(1) The complete sampling loop waves of these three timbre data files are obtained between the 1201 point and the 2100 point, between the 2901 point and the 3800 point as well as between the 1901 point and the 2800 point of corresponding timbre data files respectively.

Figure 1:
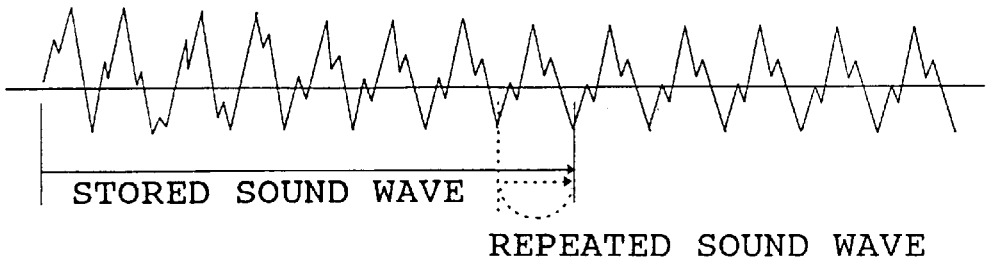
FIG. 1 is a schematic illustration of a sound wave table of a basic sound wave.
Figure 2:
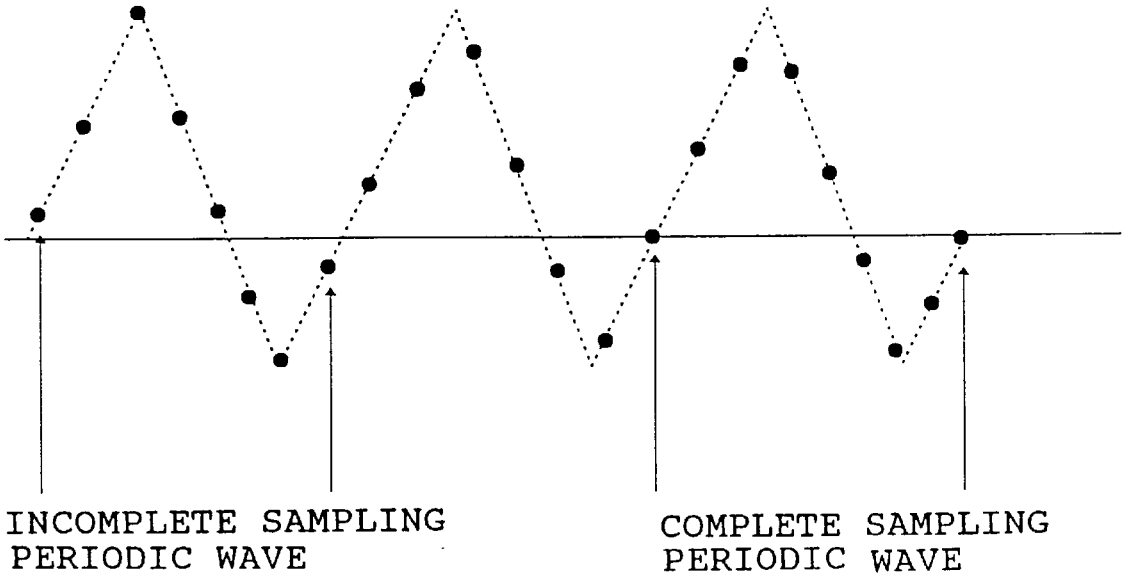
FIG. 2 is a schematic illustration of a sampling periodic wave of a sound wave.
Figure 3:
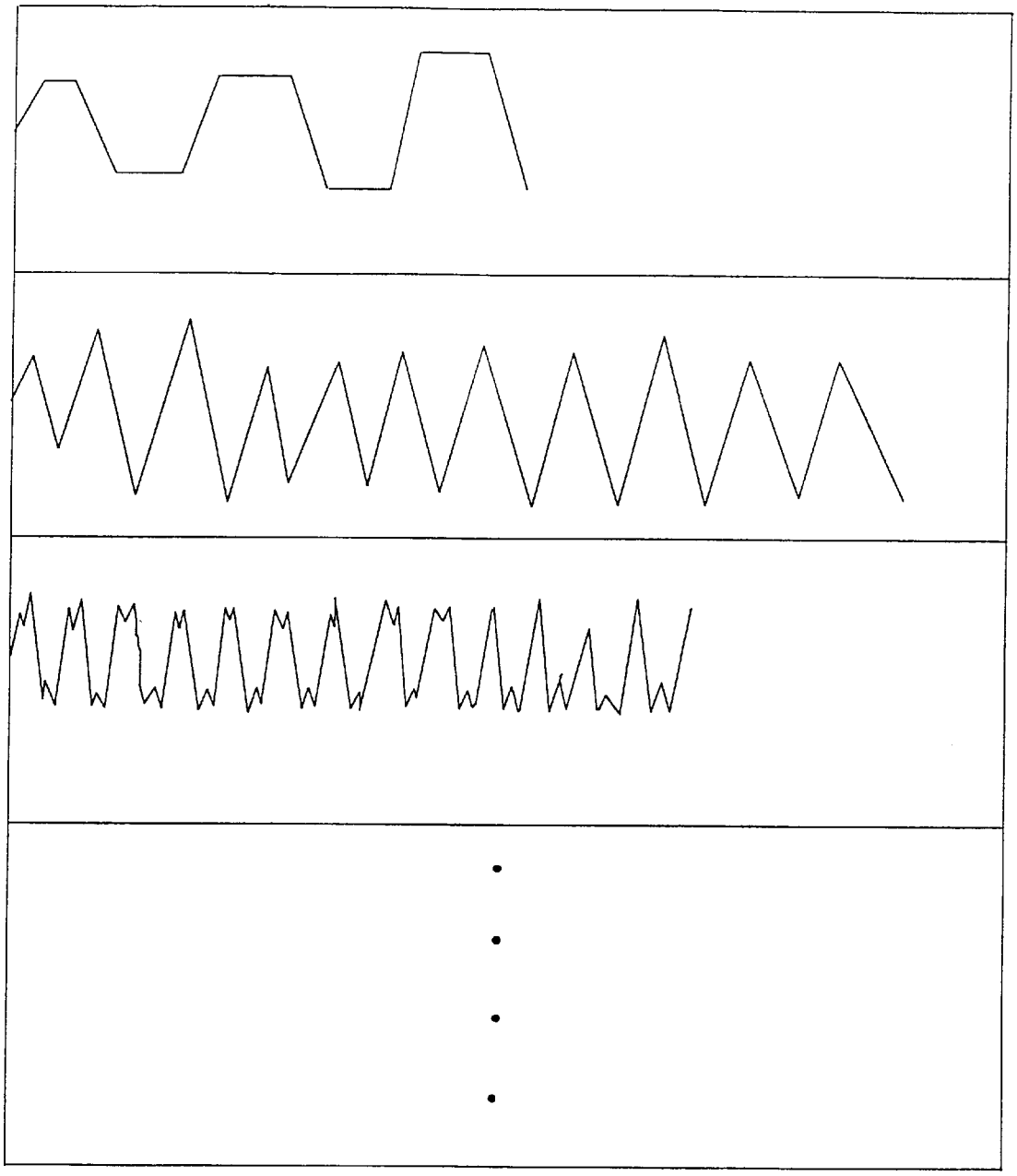
FIG. 3 is a schematic illustration of the sound waves of an instrument with different pitches.

(2) The lengths of the timbre data files of A, B and C are set at 2100 points, 3800 points and 2800 points by deleting each of the data points after the 2100 point in the A timbre data file, the data points after the 3800 point in the B timbre data file and the data points after the 2800 point in the C timbre data file respectively, as shown in FIG. 3.

(3) The lengths of these three A, B and C timbre files will be 3900 points, 3800 points and 3700 points by repeating the loop waves of A, B and C timbre data files twice, zero times and once respectively, and then are added respectively to the end of corresponding timbre data files.

Figure 5:
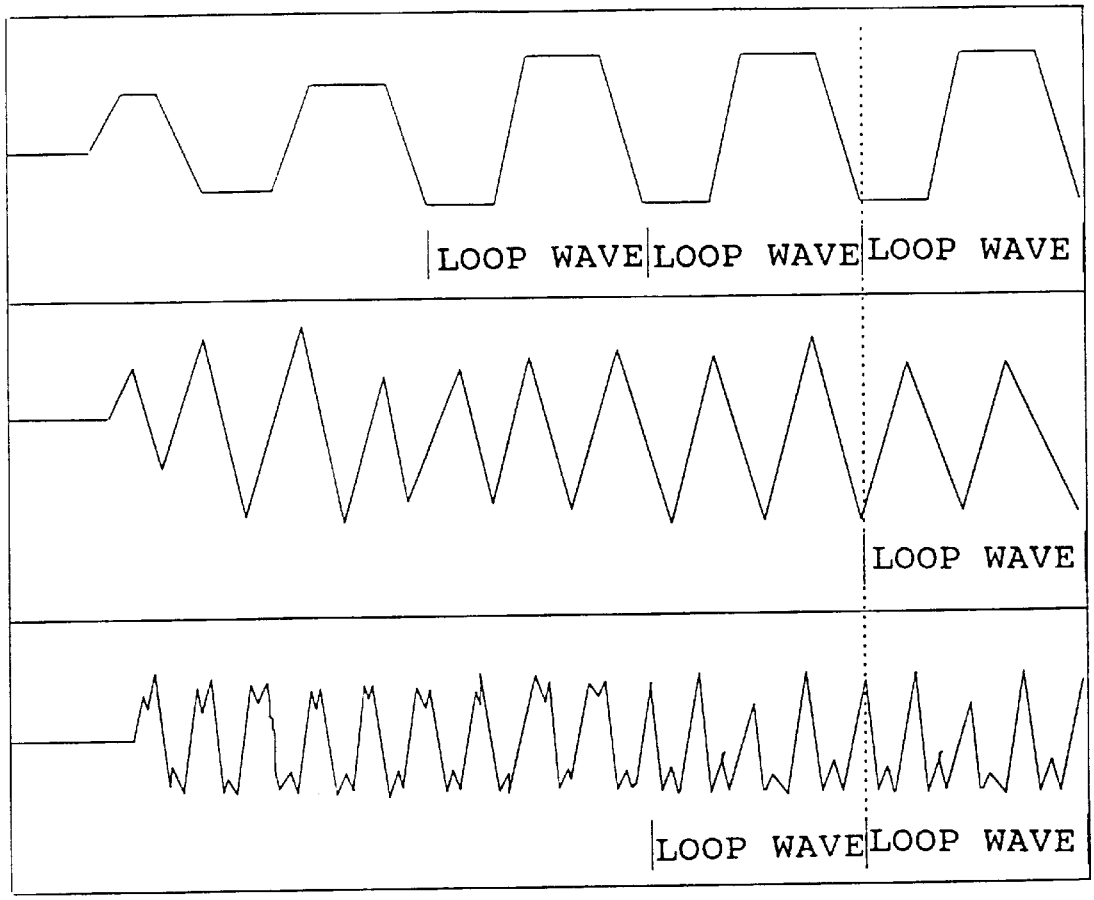
FIG. 5 is a schematic illustration shows every kind of timbre data file after the method of the present invention has been carried out.

(4) By adding 196 points, 296 points and 396 points in front of A, B and C timbre data files respectively, the lengths of these three timbre data files are all 4096 sampling points and the lengths of these three timbre data files are all 900 sampling points to form a structured timbre data base thereby, as shown in FIG. 5.

After the structured timbre base is established, every one of the timbre data files has a fixed total length and a fixed loop length. Therefore, the complexity of a hardware is reduced since the above two values of every timbre file, a fixed total length and a fixed loop length, need not be stored in a ROM, or be read out from a ROM and then be stored in a register.

Although the invention has been explained in relation to its preferred embodiment, it is to be understood that many other possible modifications and variations can be made without departing from the spirit and scope of the invention as hereinafter claimed.

I claim:

1. A method for establishing a structure timbre data base with a sound wave table, comprising the steps of:

determining a fixed total length for every timbre data file in said data base;

specifying a predetermined keynote for every musical instrument being recorded and obtaining a plurality of sound waves with a pitch of 8 scales of difference according to a specific sound of said every musical instrument being recorded;

setting a period of a sound wave with the lowest scale recorded to be a fixed loop length in said every timbre data file in the data base;

searching backwards for a complete sampling loop wave from the end of said every timbre data file;

after a complete sampling loop wave is found, deleting an end portion of said every timbre data file starting from a specified point and extending a length of said complete sampling loop wave;

repeating said complete sampling loop wave from the specified point to the end of said every timbre data file by adding the repeated complete sampling loop wave to said specified point; and adding a mute signal in front of said every timbre data file to make the total length of said every timbre data file and said fixed total length identical.

2. The method for establishing a structured timbre data base as claimed in claim 1, wherein said fixed loop length is equal to the length of said complete sampling loop wave.

3. The method for establishing a structured timbre data base as claimed in claim 1, wherein said length of said repeated complete sampling loop wave does not exceed said fixed total length of said every timbre data file.

4. The method for establishing a structured timbre data base as claimed in claim 1, wherein said length of said added mute signal is equal to a difference between said fixed total length and the length of the deleted timbre data file adding up said length of said repeated complete sampling loop wave.

5. The method for establishing a structured timbre data base as claimed in claim 1, wherein said every timbre data file has a relation of 8 scales of difference with each other.

6. The method for establishing a structured timbre data base as claimed in claim 1, wherein said complete sampling loop wave is composed of a single periodic wave.

7. The method for establishing a structured timbre data base as claimed in claim 1, wherein said complete sampling loop wave is composed of a plurality of periodic waves.

8. The method for establishing a structured timbre data base as claimed in claim 1, wherein the sampling frequencies of recorded timbres are identical.

* * * * *